United States Patent [19]

Hunter

[11] 4,308,850

[45] Jan. 5, 1982

[54] MULTIPLE ELASTIC BAND PROJECTOR

[76] Inventor: James P. Hunter, Rte. 7, Box 255E, Denham Springs, La. 70726

[21] Appl. No.: 42,519

[22] Filed: May 25, 1979

[51] Int. Cl.[3] ..... F41B 7/02

[52] U.S. Cl. ..... 124/19; 124/35 R; 124/41 R

[58] Field of Search ..... 124/19, 18, 35 R, 40, 124/41 R

[56] References Cited

U.S. PATENT DOCUMENTS

| | | | |
|---|---|---|---|
| 1,821,381 | 9/1931 | Gerken | 124/19 |
| 2,008,595 | 7/1935 | Reed | 124/19 |
| 2,021,776 | 11/1935 | Hagen | 124/19 |
| 2,576,248 | 11/1951 | Wright et al. | 124/19 |
| 3,119,385 | 1/1964 | Ashley | 124/19 |

*Primary Examiner*—Richard J. Apley
*Assistant Examiner*—William R. Browne
*Attorney, Agent, or Firm*—Roy, Kiesel, Patterson & McKay

[57] ABSTRACT

An elastic band projector is disclosed having a loading and firing mechanism for sequentially firing more than one elastic band without stopping to reload the elastic bands on the projector.

5 Claims, 1 Drawing Figure

MULTIPLE ELASTIC BAND PROJECTOR

BACKGROUND OF THE INVENTION

1. Field of the Invention

This invention relates broadly to toy guns and, more particularly, to elastic band projectors.

2. Prior Art

One of the more common toys of children has been the "rubber band" gun which is a hand-held projector that shoots elastic bands. Examples of such toy gun designs can be seen in Haws U.S. Pat. No. 1,811,010, entitled "Toy Gun", issued June 23, 1931, and Burton U.S. Pat. No. 2,455,558, entitled "Elastic Band Projector and Cap Exploder", issued Dec. 7, 1948.

One of the principal design faults of such prior art rubber band guns is their inability to sequentially fire rubber bands without reloading.

SUMMARY OF THE INVENTION

Therefore, one object of the invention is to provide an elastic band projector capable of sequentially firing rubber bands without reloading.

This and other objects and advantages of this invention shall become apparent from the ensuing descriptions of the invention.

Accordingly, an elastic band projector is provided comprising a gun stock housing assembly, an elastic band loading assembly attached to the gun stock top and having parallel corresponding multiple notched plates, and an elastic band separator strip extending over the parallel plates; and a firing assembly having a trigger means with ratchet engaging arm, a ratchet lever attached to the gun stock and positioned for sliding in a gun stock slot, a firing arm that is moved pre-set incremental distances between the parallel plates by the ratchet lever.

PREFERRED EMBODIMENTS OF THE INVENTION

Figure 1:
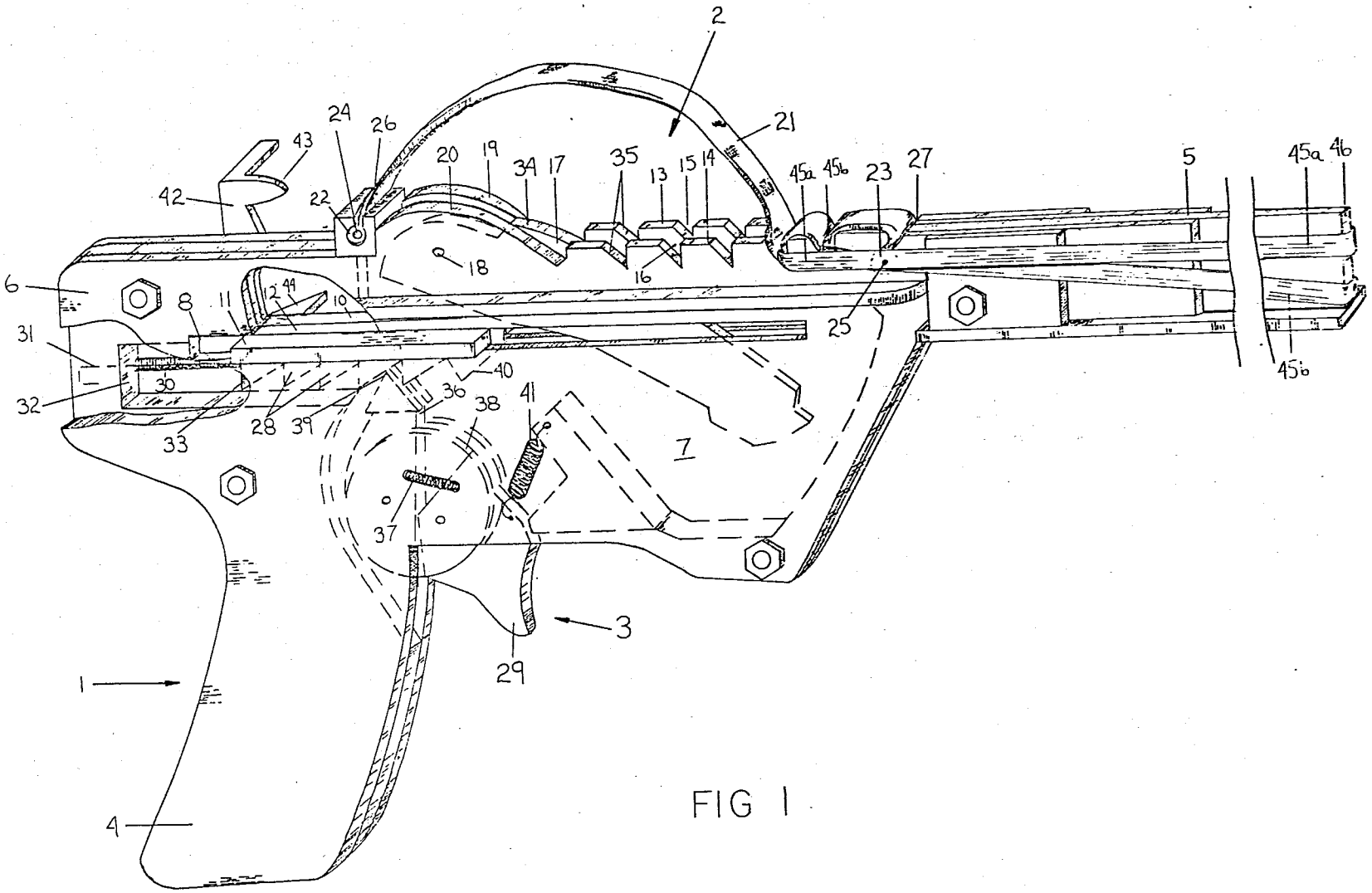
FIG. 1 is a three dimensional cutaway view of one preferred embodiment of the projector loaded with two rubber bands.

As seen in FIG. 1, a preferred embodiment of the elastic band projector is illustrated showing gun stock housing assembly 1, elastic band loading assembly 2 and firing assembly 3.

In a preferred embodiment, gun stock housing assembly 1 has a handle area 4, barrel area 5 and upper housing area 6 designed to have a conventional pistol or rifle shape. Housing assembly 1 is provided with a cavity 7 in which firing assembly 3 is positioned as described below. In the particular embodiment shown, housing assembly 1 is also provided with slots 8 and 9 through which guide members 10 and 11 of lever 12 of firing assembly 3 are positioned.

The elastic band loading assembly 2 comprises parallel plates 13 and 14 positioned between upper housing area 6 and barrel area 5 as shown. Each plate 13 and 14 is provided with multiple notches 15 and 16, respectively, that are aligned with one another. Firing arm 17 of firing assembly 3 is pivotedly attached by pin 18 between ridges 19 and 20 of loading assembly 2 so that it is free to swing between plates 13 and 14. In a preferred embodiment, a flexible ejection band 21 is attached at either end of notches 15–16 by attaching to pins 22 and 23, which fit in circular cavities 24 and 25, respectively. Slots 26 and 27 connect to cavities 24 and 25, respectively, to allow band 21 to pass through, but are too narrow to allow pins 22 and 23 to pass. Band 21 is preferably wide enough to span the distance between plates 13 and 14 and fit into notches 15 and 16.

Lever 12 is provided with ratcheting teeth 28 positioned below guide members 10 and 11 and projecting downward as shown. Each tooth 28 is positioned from its adjacent tooth a distance that allows lever 12 to move forward only a pre-set distance to push firing arm 17 from one notch 15 to the adjacent notch 16 with each squeeze of trigger finger 29 as explained below. In a preferred embodiment, spring 30 is mounted on rod shaft 31 that extends through level 12. One end of spring 30 abuts against cavity wall 32 and the other end against lever end wall 33 resulting in a force being applied against lever end wall 33. In still another preferred embodiment, lever 12 is provided with a upper surface 34 that is cammed so that the section of lever 12 adjacent to a particular notch 15–16 has the same slope as notch wall 35. This embodiment provides for more efficient and smoother projection of the elastic bands.

Firing assembly 3 comprising trigger finger 29 centrally mounted (within cavity 7) to trigger plate 38 and positioned between trigger plate 38 and gun stock housing assembly 1. Trigger plate 38 is itself pivotly mounted to gun stock housing assembly 1. Offset, but pivotly attached to trigger plate 38 is ratchet finger 36, which is also connected in a preferred embodiment to trigger finger 29 by spring 37 as shown. Ratchet finger 29 extends upward in cavity 7 until its end 39 abuts the bottom surface 40 of lever 12 to engage ratcheting teeth 28. Trigger finger 29 is held in firing position by spring 41 attached at one end to gun stock housing assembly 1 and at its opposite end to trigger finger 29.

In operation, trigger finger 29 is squeezed so that ratchet end 39 is below ratcheting teeth 28, allowing lever 12 to be pushed back toward cavity wall 32 and against spring 30. Lever 12 is held in this position by rotating safety catch 42 pivotly mounted on gun stock housing assembly 1 until hook member 43 fits around lever projection 44. Band 21 is then placed above and between plates 13 and 14. Next, elastic bands 45 are attached between notches 15–16 and barrel area end 46 and on top of band 21, as shown. Finally, safety catch 42 is released by pivoting hook member 43 up and away from lever projection 44. The projector is now ready for firing. To fire, trigger finger 29 is squeezed toward handle area 4. This forces spring 37 to rotate ratchet finger 36 upward until ratchet finger end 39 engages ratcheting teeth 28. This action forces lever 12 to move forward pushing firing arm 17 between the first pair of notches 15 and 16. As firing arm 17 is forced between the notches, the first elastic band is forced out of the notches and projected forward. Spring 41 then forces trigger finger 29 back into position to be squeezed again to fire the second elastic band and so forth.

There are, of course, many alternate embodiments not specifically disclosed but which are intended to be included within the scope of this invention as defined by the following claims.

What I claim is:

1. An elastic band projector comprising:

(a) a gun stock housing assembly;

(b) an elastic band loading assembly attached to said gun stock housing assembly, said elastic band loading assembly comprising parallel plates having notches aligned with one another; and (c) a firing assembly attached to said gun stock housing assembly, said firing assembly comprising:

(i) a firing arm pivotly attached to said elastic band loading assembly at a position to swing between said parallel notched plates, (ii) an elongated ratcheted lever means slideably positioned between parallel notched plates, attached to said gun stock housing assembly and moveable to contact and pivot said firing arm to strip successive elastic bands from the stock as said ratcheted lever is slid forwardly in said gun stock housing assembly, (iii) a trigger means pivotly attached to said gun stock housing assembly and including a trigger finger, said trigger means comprising a ratchet engaging finger attached to said trigger finger and having an upper end that engages teeth of said ratchet to cause movement of said ratchet when said trigger means is pivoted by a user, and said trigger finger extending out of said gun stock housing assembly.

2. An elastic band projector according to claim 1 wherein said gun stock housing assembly having a cavity into which said firing assembly is attachingly positioned.

3. An elastic band projector according to claim 2 wherein a spring is attached at one end to an interior wall of said cavity and its opposite end is positioned in forcing contact with said ratcheted lever to apply force against said lever to push said firing arm.

4. An elastic band projector according to claim 1 wherein a projectile ejection band is mounted at each end of said parallel plates and having a width sufficient to span said plates.

5. An elastic band projector according to claim 1 wherein said firing arm has an upper surface cammed to match the surfaces of the notches of said notched plates.

* * * * *